US011143008B1

(12) United States Patent
Haque et al.

(10) Patent No.: US 11,143,008 B1
(45) Date of Patent: Oct. 12, 2021

(54) METHODS OF HYDRAULIC FRACTURING

(71) Applicant: Saudi Arabian Oil Company, Dhahran (SA)

(72) Inventors: Mohammad H. Haque, Houston (SA); Younane N. Abousleiman, Norman, OK (US); Rajesh K. Saini, Cypress, TX (US); Katherine Hull, Houston, TX (US)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/857,757

(22) Filed: Apr. 24, 2020

(51) Int. Cl.
*E21B 43/267* (2006.01)

(52) U.S. Cl.
CPC ..... *E21B 43/267* (2013.01)

(58) Field of Classification Search
None
See application file for complete search history.

(56) References Cited

U.S. PATENT DOCUMENTS

| | | | | |
|---|---|---|---|---|
| 3,933,205 | A | 1/1976 | Kiel | |
| 7,210,528 | B1 | 5/2007 | Brannon et | |
| 8,985,213 | B2 | 3/2015 | Saini et al. | |
| 2013/0014946 | A1* | 1/2013 | Makarychev-Mikhailov | C09K 8/80 166/280.2 |
| 2016/0137910 | A1* | 5/2016 | Chang | C09K 8/80 166/280.2 |
| 2016/0341022 | A1* | 11/2016 | Fonseca Ocampos | C04B 28/04 |
| 2017/0030180 | A1* | 2/2017 | Maurer | E21B 43/305 |
| 2018/0051203 | A1* | 2/2018 | Nguyen | C09K 8/80 |
| 2018/0320498 | A1* | 11/2018 | Nguyen | C09K 8/80 |
| 2018/0335545 | A1* | 11/2018 | Dalthorp | G01V 11/002 |

FOREIGN PATENT DOCUMENTS

| | | | |
|---|---|---|---|
| EP | 2469020 | A1 | 6/2012 |
| WO | 2011081550 | A1 | 7/2011 |

OTHER PUBLICATIONS

Calvin et al., "Enhancement of Well Production in the SCOOP Woodford Shale through the Application of Microproppant", Society of Petroleum Engineers, SPE-184863-MS, Jan. 2017.

Rassenfoss, "Seeking Big Oil Production Gains by Fracturing with Microproppant", Journal of Petroleum Technology, Mar. 2017.

International Search Report and Written Opinion dated Feb. 23, 2021 pertaining to International application No. PCT/US2020/059944 filed Nov. 11, 2020, 13 pgs.

* cited by examiner

*Primary Examiner* — Andrew Sue-Ako
(74) *Attorney, Agent, or Firm* — Dinsmore & Shohl LLP

(57) ABSTRACT

Methods for performing a hydraulic fracturing operation are provided. The methods include pumping a hydraulic fracturing fluid through a wellbore into a subsurface formation, in which the hydraulic fracturing fluid comprises a plurality of proppants. Individual proppants of the plurality of proppants travel a first distance into the subsurface formation and have a persistent diameter homogeneity. The methods further include shutting in the wellbore to facilitate crushing individual proppants under formation pressure to form microproppants and resuming pumping the hydraulic fracturing fluid after crushing individual proppants and forcing the microproppants to a second distance within the subsurface formation, in which the second distance is beyond the first distance relative to the wellbore.

16 Claims, 2 Drawing Sheets

METHODS OF HYDRAULIC FRACTURING

TECHNICAL FIELD

Embodiments of the present disclosure generally relate to methods of performing a hydraulic fracturing operation of a subsurface formation for oil and gas recovery.

BACKGROUND

Hydraulic fracturing is a stimulation treatment routinely performed on oil and gas wells. Hydraulic fracturing fluids are pumped into a hydrocarbon-bearing formation causing fractures to open in the subsurface formation. Proppants, such as grains of sand of a particular size, may be mixed with the treatment fluid to keep the fracture open when the treatment is complete. To keep microfractures and nanofractures open within the subsurface formation microproppants and nanoproppants are necessary. This disclosure is related to the production of microproppants and nanoproppants in-situ thereby replacing the need for pumping such proppants from the surface.

SUMMARY

It is often desirable during and after fracturing a subsurface formation to hold the fractures open by using proppants for more effective oil and gas production. However, proppants with a diameter greater than 16/30 mesh (0.6 millimeter (mm) to 1.18 mm) or 20/40 mesh (0.425 mm to 0.850 mm) or 30/50 mesh (0.3 mm to 0.6 mm) may not provide sufficient crush resistance for use in the microfractures of a given subsurface formation. Furthermore, these proppants may not fit or be effectively transported into microfractures to prop the microfractures open. Microproppants (proppants conventionally having a diameter between 70 mesh (212 microns (μm)) to 635 mesh (20 μm)) and nanoproppants (proppants conventionally having a diameter of less than 635 mesh or 20 μm) are the most effective in stimulating the well, as they increase the overall fracture conductivity more effectively than proppants with a diameter of greater than 50 mesh or 0.3 mm.

Conventionally, microproppants and nanoproppants and proppants with a mesh size of 30/50 (0.300 mm to 0.600 mm) or 40/70 (0.212 mm to 0.425 mm) may be used in hydraulic fracturing operations. Conventional methods include pumping 30/50 mesh proppants, 40/70 mesh proppants, and microproppants each separately. Using differently sized proppants in the hydraulic fracturing operation allows larger proppants to prop open the larger fractures while also providing microproppants to prop open microfractures. However, the logistics of keeping various proppant sizes separate throughout the operation may cause complications in the operation and decrease operational efficiency.

Accordingly, a need exists for methods of hydraulic fracturing with microproppants without the added complications of keeping various proppant sizes separate throughout the hydraulic fracturing operation and pumping the various sizes of proppants separately. The methods of the present disclosure address this need by introducing a plurality of proppants that have a persistent diameter homogeneity into a subsurface formation, and shutting in the wellbore to facilitate crushing individual proppants under formation pressure to form microproppants. The phrase "persistent diameter homogeneity" means that a diameter of any individual proppant of the plurality of proppants does not vary by more than 200% from the diameter of any other individual proppant of the plurality of proppants. The methods of the present disclosure solely require a single specific mesh size or type of proppant to be pumped during the hydraulic fracturing operation, thereby increasing operation efficiency. Furthermore, resuming pumping the hydraulic fracturing fluid after crushing individual proppants forces the microproppants to a second distance within the subsurface formation, in which the second distance is beyond the first distance relative to the wellbore. This means that a benefit of the disclosed methods is the increased conductivity of the fractures when using microproppants as compared to the plurality of proppants, which means that the overall efficiency of the hydraulic fracturing operation is improved.

In accordance with an embodiment of the present disclosure, a method of hydraulic fracturing is disclosed. The method includes pumping a hydraulic fracturing fluid through a wellbore into a subsurface formation, in which the hydraulic fracturing fluid includes a plurality of proppants in which individual proppants of the plurality of proppants travel a first distance into the subsurface formation and have a persistent diameter homogeneity. The method further includes shutting in the wellbore to facilitate crushing individual proppants under formation pressure to form microproppants, and resuming pumping the hydraulic fracturing fluid after crushing individual proppants and forcing the microproppants to a second distance within the subsurface formation, in which the second distance is beyond the first distance relative to the wellbore. This process may be repeated additional times to maximize generation of microproppants of finer gradients for enhanced conductivity.

BRIEF DESCRIPTION OF THE DRAWINGS

The following detailed description of specific embodiments of the present disclosure may be best understood when read in conjunction with the following drawings, where like structures are indicated with like reference numerals and in which.

DETAILED DESCRIPTION

Figure 1:
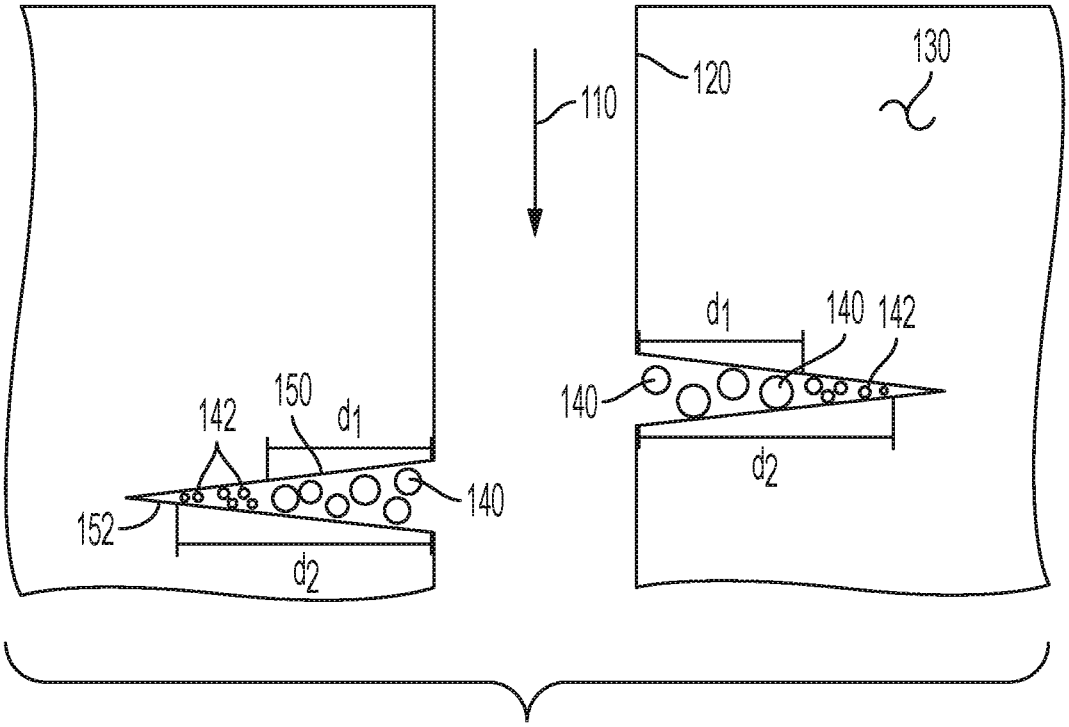
FIG. 1 schematically depicts a hydraulic fracturing treatment in a subsurface formation, according to one or more embodiments described in this disclosure.

As used throughout this disclosure, the term "formation fracture pressure" refers to pressure greater than which the injection of fluids will cause the rock formation to fracture hydraulically.

As used throughout this disclosure, the term "hydraulic fracturing" refers to a stimulation treatment performed on reservoirs with a permeability of less than 10 milliDarcys. Hydraulic fracturing fluids are pumped into a subsurface formation such that fractures form. The wings of the fracture extend away from the wellbore in opposing directions according to the natural stresses within the subsurface formation. Proppants are mixed with the treatment fluid to keep the fracture open when the treatment is completed. Hydraulic fracturing creates fluid communication within a subsurface formation and bypasses damage that may exist in the near-wellbore area.

As used throughout this disclosure, the term "subsurface formation" refers to a body of rock that is sufficiently distinctive and continuous from the surrounding rock bodies that the body of rock may be mapped as a distinct entity. A subsurface formation is, therefore, sufficiently homogenous to form a single identifiable unit including similar geological properties throughout the subsurface formation, including, but not limited to, porosity and permeability. A subsurface formation is the fundamental unit of lithostratigraphy.

As used throughout this disclosure, the term "lithostatic pressure" refers to the pressure of the weight of overburden, or overlying rock, on a subsurface formation.

As used throughout this disclosure, the term "producing subsurface formation" refers to the subsurface formation from which hydrocarbons are produced.

As used throughout this disclosure, the term "proppant" refers to particles capable of holding fractures open after a hydraulic fracturing treatment is completed.

As used throughout this disclosure, the term "reservoir" refers to a subsurface rock formation having stored hydrocarbons.

As used throughout this disclosure, the term "wellbore" refers to the drilled hole or borehole, including the openhole or uncased portion of the well. Borehole may refer to the void space defined by the wellbore wall, where the rock face that bounds the drilled hole defines the borehole.

Production wells are fluid conduits that enable hydrocarbons to travel from the subsurface formation to the surface. As hydrocarbons are produced, the pressure in the formation decreases as the amount of gas in the formation decreases. If the pressure in the formation decreases to less than the dew point of the hydrocarbon gas, then a hydrocarbon liquid condensate forms. This liquid condensate may create a fluid blockage in the formation and limit fluid access between the formation and the wellbore.

The present disclosure is directed methods for increasing a rate of hydrocarbon production from a subsurface formation through the use of proppants. In general, the hydraulic fracturing may include contacting the subsurface formation with a hydraulic fracturing fluid at a pressure greater than or equal to a formation fracture pressure of the subsurface formation.

In one or more embodiments, hydraulic fracturing fluids including proppants may be used to enhance productivity from hydrocarbon-bearing reservoir formations, including carbonate and sandstone formations. During hydraulic fracturing operations, a fracturing treatment fluid may be pumped under a pressure greater than the fracture pressure of the formation of the reservoir. Pumping this fracturing treatment fluid into the formation creates a fracture within the formation which increases the porosity and permeability of the formation and enables hydrocarbons to be extracted through the well. Fracturing operations may consist of three main stages including a pad fluid stage, a proppant fluid stage, and an overflush fluid stage.

The pad fluid stage typically consists of pumping a pad fluid into the formation. The pad fluid may be a gelled fluid which initiates and propagates the fractures. The proppant fluid stage may involve pumping a proppant fluid into the fractures of the formation. The proppant fluid composition may include proppants mixed with a gelled fluid or a visco-elastic surfactant fluid. The proppants in the proppant fluid may be lodged in the fractures and create conductive fractures through which hydrocarbons flow. The final stage, the overflush stage, may include pumping a gelled fluid into the fractures to ensure the proppant fluid is pushed inside the fractures.

The methods of the present disclosure include pumping a hydraulic fracturing fluid through a wellbore into a subsurface formation, in which the hydraulic fracturing fluid includes a plurality of proppants in which individual proppants of the plurality of proppants travel a first distance into the subsurface formation and have a persistent diameter homogeneity. In the embodiments described in the present disclosure, the persistent diameter homogeneity throughout the plurality of proppants is such that, for an individual proppant, the extrema (i.e., the minimum or maximum) of the diameter of individual proppants of the plurality of proppants is greater than or equal to about 50% and less than or equal to about 500% of the diameter of any individual proppant of the plurality of proppants. In some embodiments, the extrema is greater than or equal to about 50% and less than or equal to about 400% of the diameter of any individual proppant of the plurality of proppants. In some embodiments, the extrema is greater than or equal to about 50% and less than or equal to about 300% of the diameter of any individual proppant of the plurality of proppants. In some embodiments, the extrema is greater than or equal to about 50% and less than or equal to about 200% of the diameter of any individual proppant of the plurality of proppants. In some embodiments, the extrema is greater than or equal to about 50% and less than or equal to about 150% of the diameter of any individual proppant of the plurality of proppants.

In some embodiments, surface pumps introduce the hydraulic fracturing fluid into the subsurface formation at a pressure greater than or equal to a formation fracture pressure of the subsurface formation. This pressure results in cracks within the subsurface formation, forming fractures.

A hydraulic fracturing fluid may be used to propagate fractures within a subsurface formation and further open fractures. In embodiments, the hydraulic fracturing fluid may include an aqueous phase, a clay-based component, and a plurality of proppants. The clay-based component may include one or more components selected from the group consisting of lime (CaO), $CaCO_3$, bentonite, montmorillonite clay, barium sulfate (barite), hematite ($Fe_2O_3$), mullite ($3Al_2O_3.2SiO_2$ or $2Al_2O_3.SiO_2$), kaolin, ($Al_2Si_2O_5(OH)_4$ or kaolinite), alumina ($Al_2O_3$, or aluminum oxide), silicon carbide, tungsten carbide, and combinations thereof.

In embodiments, the hydraulic fracturing fluid may include slick water fluid, crosslinked fluid, linear gel, oil-based fluid, visco-elastic surfactant-based fluid, acid fluid, an aqueous phase, or combinations thereof. The hydraulic fracturing fluid may have viscoelastic properties or may be a yield stress fluid.

As stated previously, the hydraulic fracturing fluid may include an aqueous phase. The aqueous phase may include fresh water, salt water, brine, municipal water, formation water, produced water, well water, filtered water, distilled water, deionized water, sea water, or combinations thereof. In some embodiments, the water may include additives or contaminants. For instance, the water may include freshwater or seawater, natural or synthetic brine, or salt water. In some embodiments, salt or other organic compounds may be incorporated into the water to control certain properties of the water, and thus the hydraulic fracturing fluid, such as density. Without being bound by any particular theory, increasing the saturation of water by increasing the salt concentration or the level of other organic compounds in the water may increase the density of the water, and thus, the hydraulic fracturing fluid. Suitable salts may include, but are not limited to, alkali metal chlorides, hydroxides, or carboxylates. In some embodiments, suitable salts may include sodium, calcium, cesium, zinc, aluminum, magnesium, potassium, strontium, silicon, lithium, chlorides, bromides, carbonates, iodides, chlorates, bromates, formates, nitrates, sulfates, phosphates, oxides, fluorides and combinations of these. In some particular embodiments, brine may be used in the aqueous phase. Without being bound by any particular theory, brine may be used to create osmotic balance between the hydraulic fracturing fluid and the subterranean formation.

The aqueous hydraulic fracturing fluid may include from 10 wt. % to 99 wt. % water based on the total weight of the hydraulic fracturing fluid. In some embodiments, the hydraulic fracturing fluid may include from 28 to 850 lb/bbl of water based on the total weight of the hydraulic fracturing fluid. The hydraulic fracturing fluid may include from 28 lb/bbl to 810 lb/bbl, from 30 to 800 lb/bbl, from 50 to 800 lb/bbl, from 75 to 800 lb/bbl, or from 100 to 800 lb/bbl of water. In some embodiments, the hydraulic fracturing fluid may include from 200 to 800, or 300 to 600, or 500 to 810 lb/bbl of the oleaginous phase. In some embodiments, the hydraulic fracturing fluid may include from 28 to 630 lbs/bbl, such as from 30 to 600 lbs/bbl, from 50 to 500 lbs/bbl, from 100 to 500 lb/bbl, or 200 to 500 lbs/bbl of water. In slick water fracturing the fracturing fluid may include greater than 97 wt. % water. In embodiments where the fracturing fluid includes crosslinked fluid, the fracturing fluid may include greater than 95 wt. % water. The hydraulic fracturing fluid may be pumped at a rate from 80 to 120 barrels per minute.

In some embodiments, the hydraulic fracturing fluid may also include at least one additive. The one or more additives may be any additives known to be suitable for hydraulic fracturing fluids. The hydraulic fracturing fluid may include dilute acids, biocides, breakers, corrosion inhibitors, crosslinkers, friction reducers, gels, potassium chloride, oxygen scavengers, pH adjusting agents, scale inhibitors, surfactants, flowback enhancers, gel stabilizers, clay inhibitors, solvents, or combinations thereof.

The surfactant may be anionic, cationic, zwitterionic, or nonionic. The anionic surfactants may include at least one of sulfate esters, sulfonate esters, phosphate esters, and carboxylates. The nonionic surfactants may include at least one of ethoxylates, fatty acid esters of polyhydroxy compounds, amine oxides, sulfoxides, and phosphine oxides. The ethoxylates may include at least one of fatty alcohol ethoxylates, alkylphenol ethoxylates, fatty acid ethoxylates, ethoxylated fatter esters, ethoxylated oils, ethoxylated amines, fatty acid amides, and terminally blocked ethoxylates. The fatty acid esters of polyhydroxy compounds may include at least one of fatty acid esters of glycerol, fatty acid esters of sorbitol, fatty acid esters of sucrose, and alkyl polyglucosides.

The hydraulic fracturing fluid in the subsurface fracture may include proppants suspended in the hydraulic fracturing fluid. In some embodiments, the proppants may be distributed throughout the hydraulic fracturing fluid. The hydraulic fracturing fluid may be pumped into the subsurface formation.

The proppants may be chosen from any type of proppant suitable for use in hydraulic fracturing applications. As previously described, proppants are propping agent particles used in hydraulic fracturing fluids to maintain and hold open subsurface fractures during or following subsurface treatment. In some embodiments, the proppants may include particles of materials such as oxides, silicates, silica (sand) (such as Ottawa, Brady or Colorado Sands), ceramics (including aluminosilicates such as "CARBOLITE," "NAPLITE" or "ECONOPROP"), sintered bauxite, plastic, mineral, glass, hollow glass spheres, thermoplastic polymers, thermoset polymers, walnut shell, pits, husks, quartz, aluminum pellets, synthetic organic particles such as nylon pellets, or combinations thereof. In addition, protective and/or hardening coatings, such as resins or epoxy to modify or customize the density of a selected base proppant, e.g., ground walnut hulls, etc., resin-coated sand (such as "ACME BORDEN PR 6000" or "SANTROL TEMPERED HS"), resin-coated ceramic particles and resin-coated sintered bauxite may be used. For instance, the proppants may include graded sand, treated sand, ceramic proppant, plastic proppant, or other materials. The proppants may include particles of bauxite, sintered bauxite, $Ti^{4+}$/polymer composites, where the superscript "4+" stands for the oxidation state of titanium, titanium nitride (TiN), or titanium carbide. The proppants may include glass particles or glass beads. Embodiments of the present disclosure may utilize at least one type of proppant and in embodiments in which more than one type of proppant is used, the proppants may include a mixture of two or more different materials or three or more different materials.

The material of the proppants may be chosen based on the particular application and characteristics desired, such as the depth of the subsurface formation in which the proppants will be used, as proppants with greater mechanical strength are needed at greater lithostatic pressures. For instance, ceramic proppant materials exhibit greater strength, thermal resistance, and conductivity than sands. Additionally, ceramic proppant materials have more uniform size and shape than sands.

The proppants may include various sizes or shapes. In some embodiments, the one or more proppants may have sizes from 140 mesh to 8 mesh (diameters from 106 microns (μm) to 2380 μm). In some embodiments, the proppant particles may have sizes from 8 mesh to 16 mesh (diam. 2380 μm to 1180 μm), 16 mesh to 30 mesh (diam. 600 μm to 1180 μm), 20 mesh to 40 mesh (diam. 420 μm to 840 μm), 30 mesh to 50 mesh (diam. 300 μm to 600 μm), 40 mesh to 70 mesh (diam. 212 μm to 420 μm) or 70 mesh to 140 mesh (diam. 106 μm to 212 μm). In some embodiments, individual proppant particles may have a diameter of from 100 to 3000 μm. The sphericity and roundness of the proppant particles may also vary based on the desired application.

Proppants within the hydraulic fracturing fluid may aid in treating subsurface fractures, to prop open and keep open the fracture. The method may include producing a first rate of production of hydrocarbons from the subsurface formation, introducing a hydraulic fracturing fluid including the plurality of proppants into the subsurface formation, and increasing hydrocarbon production from the subsurface formation by producing a second rate of production of hydrocarbons from the subsurface formation, in which the second rate of production of hydrocarbons is greater than the first rate of production of hydrocarbons. The rate of hydrocarbon production may increase by at least 5%, 10%, 15%, 20%, 25%, 40%, 50%, 60%, 75%, 100%, 150%, 200%, 250%, or 300%.

The method further includes shutting in the wellbore to facilitate crushing individual proppants under formation pressure to form microproppants, and resuming pumping the hydraulic fracturing fluid after crushing individual proppants and forcing the microproppants to a second distance within the subsurface formation, in which the second distance is beyond the first distance relative to the wellbore. By shutting in the well, the lithostatic pressure of the formation applies pressure to close the fracture, which in turn applies pressure to the individual proppants. This pressure may exceed the compressive strength of from 5% to 40% of the plurality of proppants, forming microproppants. Specifically, when the formation pressure exceeds the compressive strength of individual proppants of the plurality of proppants, these individual proppants will fracture and form microproppants. These microproppants will then be forced to a second distance within the subsurface formation after pumping resumes. This second distance is beyond the first distance relative to the wellbore, where the fracture has a lesser width than the plurality of proppants were not able to enter to prop open. This method may be calibrated to a given subsurface formation dependent upon the pressures of the formation, the size of the fractures, the depth of the subsurface formation, and the size of individual proppants of the plurality of proppants.

Figures 2A, 2B, 2C:
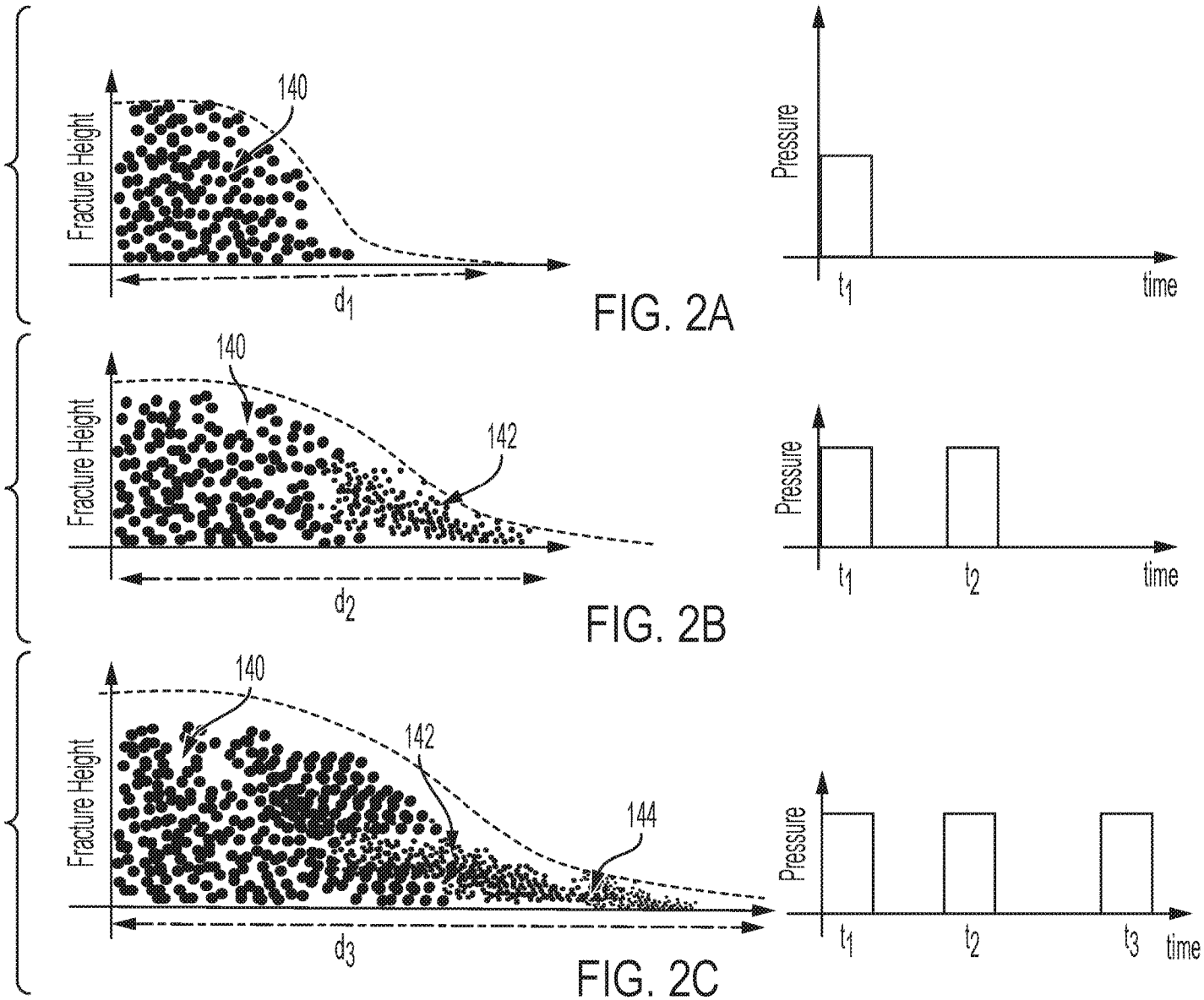
FIG. 2A schematically depicts a pumping and shutting schedule during a hydraulic fracturing treatment in a subsurface formation, according to one or more embodiments described in this disclosure.
FIG. 2B schematically depicts a pumping and shutting schedule during a hydraulic fracturing treatment in a subsurface formation, according to one or more embodiments described in this disclosure.
FIG. 2C schematically depicts a pumping and shutting schedule during a hydraulic fracturing treatment in a subsurface formation, according to one or more embodiments described in this disclosure.

Referring to FIGS. 1-2C, a hydraulic fracturing fluid 110 is pumped through a wellbore 120 into a subsurface formation 130. The hydraulic fracturing fluid 110 includes a plurality of proppants 140, and individual proppants of the plurality proppants 140 in the hydraulic fracturing fluid 110 enter a fracture 150 in the subsurface formation 130 and travel a first distance $d_1$ into the subsurface formation 130 at $t_1$. The wellbore 120 is then shut in at $t_2$ to facilitate crushing individual proppants of the plurality of proppants 140 under formation pressure to form microproppants 142. The hydraulic fracturing fluid 110 is again pumped through the wellbore 120 into the subsurface formation 130 and forces the microproppants 142 to a second distance $d_2$ within the subsurface formation 130. The second distance $d_2$ is beyond the first distance $d_1$ relative to the wellbore 120. Furthermore, in some embodiments, forcing the microproppants 142 to a second distance $d_2$ within the subsurface formation 130 includes forcing the microproppants 142 into microfractures 152 within the subsurface formation 152. The microfractures 152 may have a width of less than 500 microns (μm), of less than 200 μm, or of less than 50 μm.

Referring to FIGS. 1-2C, in embodiments, the wellbore may be shut in at $t_3$ to facilitate further crushing of the microproppants 142 to form nanoproppants 144. The hydraulic fracturing fluid may then again be pumped through the wellbore into the subsurface formation and force the nanoproppants 144 to a third distance $d_3$ within the subsurface formation. The third distance $d_3$ is beyond the second distance $d_2$ relative to the wellbore.

Crush percentage is the percentage of proppants that will be crushed at a given pressure in downhole conditions, where pressure may be greater than 20 psi, 200 psi, 500 psi, 1000 psi, 2000 psi, 3000 psi, 5000 psi, 7000 psi, or 10000 psi. Crushing the individual proppants may include crushing from 5% to 90%, from 5% to 75%, from 5% to 50%, from 5% to 45%, from 5% to 40%, from 5% to 35%, from 5% to 25%, from 5% to 15%, from 5% to 10%, from 10% to 90%, from 10% to 75%, from 10% to 50%, from 10% to 45%, from 10% to 40%, from 10% to 35%, from 10% to 25%, from 10% to 15%, from 15% to 90%, from 15% to 75%, from 15% to 50%, from 15% to 45%, from 15% to 40%, from 15% to 35%, from 15% to 25%, from 25% to 90%, from 25% to 75%, from 25% to 50%, from 25% to 45%, from 25% to 40%, from 25% to 35%, from 35% to 90%, from 35% to 75%, from 35% to 50%, from 35% to 45%, from 35% to 40%, from 40% to 90%, from 40% to 75%, from 40% to 50%, from 40% to 45%, from 45% to 90%, from 45% to 75%, from 45% to 50%, from 50% to 90%, from 50% to 75%, or from 75% to 90% of the individual proppants of the plurality of proppants. The plurality of proppants may have a crush percentage of less than 50%, less than 40%, less than 30%, less than 20%, less than 15%, less than 12%, less than 10%, less than 8%, less than 7%, less than 5%, less than 3%, less than 2%, or of 10% at 6000 psi. The plurality of proppants may have a crush percentage of less than 70%, less than 50%, less than 40%, less than 35%, less than 30%, less than 25%, less than 20%, less than 15%, less than 10%, or of 25% at 8000 psi. The plurality of proppants may have a crush percentage of less than 70%, less than 50%, less than 40%, less than 35%, less than 30%, less than 25%, less than 20%, less than 15%, less than 10%, or of 30% at 10000 psi.

The microproppants may have a diameter of less than 1000 μm, less than 500 μm, less than 400 μm, less than 300 μm, less than 250 μm, less than 200 μm, less than 150 μm, less than 100 μm, less than 75 μm, less than 50 μm, or less than 25 μm.

In some embodiments, the microproppants may have a rough surface texture. The term "rough" refers to a surface having at least one deviation from the normalized plane of the surface, such as a depression or protrusion. The surface may be uneven and irregular and may have one or more imperfections, such as dimples, stipples, bumps, projections or other surface defects. The rough surface may have an arithmetic average roughness ($R_a$) of greater than or equal to 1 nanometer (nm) (1 nm=0.001 μm). $R_a$ is defined as the arithmetic average of the differences between the local surface heights and the average surface height and may be described by Equation 1, contemplating n measurements:

$$R_a = \frac{1}{n}\sum_{i=1}^{n}|y_i| \qquad \text{EQUATION 1}$$

In Equation 1, each $y_i$ is the amount of deviation from the normalized plane of the surface (meaning the depth or height of a depression or protrusion, respectively) of the absolute value of the ith of n measurements. Thus, $R_a$ is the arithmetic average of the absolute values of n measurements of deviation y from the normalized plane of the surface. In some embodiments, the surface of the proppant may have an $R_a$ of greater than or equal to 2 nm (0.002 μm), or greater than or equal to 10 nm (0.01 μm), or greater than or equal to 50 nm (0.05 μm), or greater than or equal to 100 nm (0.1 μm), or greater than or equal to 1 μm.

The plurality of proppants may have an aspect ratio (length divided by width) of greater than 1. Because the plurality of proppants have an aspect ratio of greater than 1, the proppants may lock together thereby reducing proppant flowback. Furthermore, the edges of the plurality of proppants having an aspect ratio as previously described may be more susceptible to breaking under lithostatic pressure to create microproppants as described in this disclosure. The sharp and uneven edges of the plurality of proppants with an aspect ratio as previously described may create stress concentrations that are readily broken into microproppants. In contrast, proppants with an aspect ratio of less than 1 may have smooth surfaces and are therefore less susceptible to crushing.

Compressive strength is the resistance of a material to breaking under compression. A material with a greater compressive strength suffers less fracturing at a given pressure as compared to a material with a lesser compressive strength. Greater compressive strength is desirable, as the proppants are less likely to fracture in downhole conditions, where pressure may be greater than 20 psi, 200 psi, 500 psi, 1000 psi, 2000 psi, 3000 psi, 5000 psi, 7000 psi, or 10000 psi. The microproppants formed by shutting in the well to facilitate crushing individual proppants under formation pressure will have increased compressive strength as compared to the individual proppants of the plurality of proppants. The microproppants may have a compressive strength of from 3500 to 6000 psi, from 3500 to 5500 psi, from 3500 to 5200 psi, from 3500 to 5000 psi, from 3500 to 4700 psi, from 3500 to 4500 psi, from 3500 to 4100 psi, from 4000 to 6000 psi, from 4000 to 5500 psi, from 4000 to 5200 psi, from 4000 to 5000 psi, from 4000 to 4700 psi, from 4000 to 4500 psi, from 4500 to 6000 psi, from 4500 to 5500 psi, from 4500 to 5200 psi, from 4500 to 5000 psi, from 4500 to 4700 psi, from 4700 to 6000 psi, from 4700 to 5500 psi, from 4700 to 5200 psi, from 4700 to 5000 psi, from 5000 to 6000 psi, from 5000 to 5500 psi, from 5000 to 5200 psi, or from 4000 to 5200 psi, meaning that the microproppants will not fracture until the compressive strength has been exceeded.

The method may further include producing hydrocarbons from the subsurface formation. In some embodiments, the method includes increasing a rate of hydrocarbon production from the subsurface formation. The method may further include producing a first rate of hydrocarbon production from the subsurface formation before pumping the hydraulic fracturing fluid, and producing a second rate of hydrocarbon production from the subsurface formation after resuming pumping the hydraulic fracturing fluid, in which the second rate of hydrocarbon production is greater than the first rate of hydrocarbon production. In some embodiments, the second rate of hydrocarbon production is two times greater than the first rate of hydrocarbon production.

Embodiments of methods of treating a subsurface formation may include propagating at least one subsurface fracture in the subsurface formation to treat the subsurface formation. In some embodiments, the subsurface formation may be a rock or shale subsurface formation. In some embodiments, contacting of the subsurface formation may include drilling into the subsurface formation and subsequently injecting the hydraulic fracturing fluid into at least one subsurface fracture in the subsurface formation. In some embodiments, the hydraulic fracturing fluid may be pressurized before being injected into the subsurface fracture in the subsurface formation.

It should be apparent to those skilled in the art that various modifications and variations may be made to the embodiments described within without departing from the spirit and scope of the claimed subject matter. Thus, it is intended that the specification cover the modifications and variations of the various embodiments described within provided such modifications and variations come within the scope of the appended claims and their equivalents.

Having described the subject matter of the present disclosure in detail and by reference to specific embodiments thereof, it is noted that the various details disclosed within should not be taken to imply that these details relate to elements that are essential components of the various embodiments described within, even in cases where a particular element is illustrated in each of the drawings that accompany the present description. Further, it should be apparent that modifications and variations are possible without departing from the scope of the present disclosure, including, but not limited to, embodiments defined in the appended claims. More specifically, although some aspects of the present disclosure are identified as particularly advantageous, it is contemplated that the present disclosure is not necessarily limited to these aspects.

What is claimed is:

1. A method of hydraulic fracturing comprising:

pumping a hydraulic fracturing fluid through a wellbore into a subsurface formation, in which the hydraulic fracturing fluid comprises a plurality of proppants in which individual proppants of the plurality of proppants travel a first distance into the subsurface formation and have a persistent diameter homogeneity;

shutting in the wellbore to facilitate crushing individual proppants under formation pressure to form microproppants; and resuming pumping the hydraulic fracturing fluid after crushing individual proppants and forcing the microproppants to a second distance within the subsurface formation, in which:

the second distance is beyond the first distance relative to the wellbore; and forcing the microproppants to a second distance within the subsurface formation comprises forcing the microproppants into microfractures within the subsurface formation.

2. The method of claim 1, in which the microfractures have a width of less than 500 μm.

3. The method of claim 1, in which the microfractures have a width of less than 200 μm.

4. The method of claim 1, in which the microfractures have a width of less than 50 μm.

5. The method of claim 1, further comprising producing hydrocarbons from the subsurface formation.

6. The method of claim 1, further comprising increasing a rate of hydrocarbon production from the subsurface formation.

7. The method of claim 6, in which the rate of hydrocarbon production increases by at least 50%.

8. The method of claim 1, further comprising:

producing a first rate of hydrocarbon production from the subsurface formation before pumping the hydraulic fracturing fluid; and producing a second rate of hydrocarbon production from the subsurface formation after resuming pumping the hydraulic fracturing fluid, in which the second rate of hydrocarbon production is greater than the first rate of hydrocarbon production.

9. The method of claim 8, in which the second rate of hydrocarbon production is two times greater than the first rate of hydrocarbon production.

10. The method of claim 1, in which the plurality of proppants are one of 20 to 40 mesh, 30 to 50 mesh, or 40 to 70 mesh.

11. The method of claim 1, in which crushing the individual proppants comprises crushing from 5% to 40% of the individual proppants of the plurality of proppants.

12. The method of claim 1, in which the microproppants have a diameter of less than 200 μm.

13. The method of claim 1, in which the microproppants have a diameter of less than 100 μm.

14. The method of claim 1, in which the hydraulic fracturing fluid comprises an aqueous phase.

15. The method of claim 14, in which the aqueous phase comprises fresh water, salt water, brine, municipal water, formation water, produced water, well water, filtered water, distilled water, sea water, or combinations thereof.

16. The method of claim 1, in which the hydraulic fracturing fluid comprises acids, biocides, breakers, corrosion inhibitors, crosslinkers, friction reducers, gels, potassium chloride, oxygen scavengers, pH adjusting agents, scale inhibitors, surfactants, flowback enhancers, gel stabilizers, clay inhibitors, solvents, or combinations thereof.

* * * * *